US009190033B2

(12) United States Patent
Bradley et al.

(10) Patent No.: US 9,190,033 B2
(45) Date of Patent: Nov. 17, 2015

(54) CAPO

(71) Applicant: Thalia Capos LLC, Orinda, CA (US)

(72) Inventors: Christopher Michael Bradley, Orinda, CA (US); Roland Jeffrey Wyatt, Bozeman, MT (US); Jeffrey Alan Tilley, La Honda, CA (US); Thalia Roze Bradley, Orinda, CA (US)

(73) Assignee: Thalia Capos LLC, Orinda, CA (US)

( * ) Notice: Subject to any disclaimer, the term of this patent is extended or adjusted under 35 U.S.C. 154(b) by 0 days.

(21) Appl. No.: 14/534,080

(22) Filed: Nov. 5, 2014

(65) Prior Publication Data

US 2015/0128784 A1 May 14, 2015

Related U.S. Application Data

(60) Provisional application No. 61/902,711, filed on Nov. 11, 2013.

(51) Int. Cl.
*G10D 3/00* (2006.01)
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS 4,143,576 A * 3/1979 Nichols ..... G10D 3/043 84/318
4,250,790 A 2/1981 Shubb et al.
4,503,747 A 3/1985 Labbe
4,823,670 A 4/1989 Gherman et al.
D372,259 S * 7/1996 Kyser ..... D17/20
5,792,969 A 8/1998 Shubb
6,008,441 A * 12/1999 Steinberger ..... G10D 3/043 84/318
6,271,448 B1 8/2001 Steinberger
6,459,025 B1 10/2002 D'Addario
6,528,711 B1 * 3/2003 Paige ..... G10D 3/043 84/318
6,635,813 B2 10/2003 Campling
6,835,880 B1 * 12/2004 Silva ..... G10D 3/043 84/315
D585,479 S * 1/2009 Campling ..... D17/20
7,511,208 B1 * 3/2009 Kyser ..... G10D 3/043 84/318
7,566,824 B2 * 7/2009 Small ..... G10D 3/043 84/318
7,745,710 B2 6/2010 Campling
7,932,450 B2 4/2011 Chen
7,939,736 B2 5/2011 Campling
7,956,263 B1 6/2011 Volk, Jr. et al.
7,973,227 B2 7/2011 Paige
D705,344 S * 5/2014 Kyser ..... D17/20
8,779,262 B1 * 7/2014 Steinberger ..... G10D 3/043 84/318
D717,367 S * 11/2014 Kyser ..... D17/20
2008/0168882 A1 * 7/2008 Campling ..... G10D 3/043 84/318
2010/0224049 A1 * 9/2010 Tran ..... G10D 3/043 84/318
2011/0036229 A1 2/2011 Chen
2015/0128784 A1 * 5/2015 Bradley ..... G10D 3/043 84/318

* cited by examiner

*Primary Examiner* — Robert W Horn
(74) *Attorney, Agent, or Firm* — Terra Law LLP; Benedict O'Mahoney

(57) ABSTRACT

The present invention is directed to a capo for use with a stringed musical instrument and which is engaged from the bottom portion of the neck of the musical instrument. The capo has a generally L-shaped frame connected to a lever and a pincher configured so that pressure applied to the lever causes the pincher to move toward the lever, allowing the space between the pincher and free end portion of the frame to receive the neck of the musical instrument. The exterior of the frame is configured to received interchangeable inlays, and the free end portion of the frame is configured to receive changeable neck pads.

25 Claims, 13 Drawing Sheets

CAPO

CROSS-REFERENCE TO RELATED APPLICATIONS

The present application claims the benefit of U.S. Provisional Application No. 61/902,711, filed on Nov. 11, 2013, incorporated by reference herein and for which benefit of the priority date is hereby claimed.

FEDERALLY SPONSORED RESEARCH

Not applicable.

SEQUENCE LISTING OR PROGRAM

Not applicable.

FIELD OF INVENTION

The present invention relates to a capo, for use with a stringed musical instrument to effectively change the key in which the instrument is playing. More particularly, the present invention relates to a capo having quick implementation capability, changeable neck pads, and changeable inlays.

BACKGROUND OF THE INVENTION

A number of different capos are known for use with stringed musical instruments, particularly guitars, banjos and the like, which have a neck portion including a fretboard on which the strings are played. The capo is a clamping device which fits on the instrument neck, and which is used to selectively clamp the strings against the fretboard so as to alter the effective length of vibration of the strings, and thereby to selectively raise the respective tones produced thereby.

A number of different capos are known and commercially available. Each of these is basically a clamping device in which a padded clamping bar is caused to press transversely across the strings by operation of an adjustable clamping mechanism that interacts with the underside of the neck below the fretboard.

An invention is needed that specifically addresses the problem of quickly changing the key in which a guitar plays, preferably with one hand. It is very difficult to put on, take off and move around the neck any of the existing capos with one hand, especially the fret board hand. Most capos require two hands to properly position. Even to move the capo around the neck from fret to fret takes some effort with most of the capos on the market. Additionally, it would be advantageous to have a capo that provided for a certain amount of personalization.

Most capos have neck pads comprised of fixed rubber cross bar that press down on the fret. Capos with different fixed neck pads can be used to change different characteristics. For example, a capo can come in 5 different models with neck pad lengths ranging from 40 mm to 65 mm.

One style of capo is known as a strap-on. In a strap-on capo, a rubber-covered bar is placed over the strings and a strap is attached to either end of the bar (wrapped around the back of the neck of the instrument) which holds the bar tightly to the neck. A strap-on capo commonly features either an elastic strap, or a fabric strap which can be adjusted by some method to set tightness.

Modern twists on the strap-on include a semi-flexible plastic "strap" connected to the bar on one side which is adjustable on the other side by a ratchet system. Strap-on capos vary from the other types of capos in that most other capos contain only rigid parts, and most other styles do not wrap entirely around the neck of the instrument. This full wrap allows for fairly even pressure of the capo bar across all of the strings of the instrument. The strap-on capo is commonly a low-cost capo option, and is one of the earlier styles of capo. Because the strap material is stretched to create a tight fit, the straps on these capos can be prone to stretching and wear.

One of the more common modern capo styles is the spring-clamp "trigger-style". The most common form of this type of capo has two bars: a rubber-covered bar to bane the strings, and another that presses against the back of the neck of the instrument to hold the first bar to the strings (this second bar is commonly curved or shaped to match the contour of the back of the neck). The two bars are attached on a pivot at one end; a spring presses the bars together.

Each bar has a 'grip' attached at a right angle to the bar; the two grips, when squeezed together by the user, pull the two bars apart, allowing the user to quickly release the capo's grip, apply or adjust the capo, then release the grips, allowing the spring to pull the bars together again. The look of the grips, and the action of squeezing them is akin to a gun's trigger, leading to the name of this capo. These are the most common design referred to as "quick-release" capos.

Though other styles also use that term, the trigger-style capo, because it can be operated by one hand in one single squeezing motion, is typically the quickest capo to apply or move on the instrument; other capos can be quicker and easier to remove from the instrument. One disadvantage to the trigger-style capo is that the pressure of the spring is not adjustable. The spring will apply its maximum pressure to hold the strings down, which could have an effect on the tuning of some guitars if not applied properly. These capos can typically be applied either to the treble or bass side of the instrument, depending on the player's preference. Trigger-style capos are engaged from the upper portion of the neck; in other words, as you are holding a stringed instrument in playing position with the neck horizontal, the capo is engaged with the neck by squeezing the capo to open it above the neck and bring it down from above the upper portion of the neck (distal to the ground on a horizontal plane) to engage with the neck.

Certain manufacturers have created their own unique attempts to create the ideal capo. One of the more popular and well recognized capos is the Shubb capo. The Shubb capo is applied by holding the capo in its desired location, and closing a lever to secure the capo. The unique aspect of this capo is that the lever presses against a second arm that presses against the back of the neck of the instrument. The amount of pressure the lever exerts is adjustable by a screw so that the capo can exert the minimal amount of pressure required to hold down the strings.

This is claimed to have the least impact possible on the tuning of the instrument. The Shubb capo has the disadvantage of requiring two hands to properly apply or move, and its adjustment is more complicated than some other capos; however, because of the lever design, the capo can be removed quickly by simply releasing the lever. This is particularly true if the capo is applied from the treble side of the instrument, which will allow the capo to drop off of the instrument in an instant.

There are numerous other forms of capos, many of which are variations on the above-noted designs, including: a) a screw-on capo which has some form of surface that presses against the back of the neck of the instrument to hold the bar in place against the strings. This back surface is held to the neck by a screw which is tightened to apply direct pressure. One form of this capo is effectively a rubber-covered bar built into a C-clamp; b) a roller capo facilitates quick key changes in the middle of tunes or sets by having rollers both holding down the strings and behind the neck, allowing the capo to roll along the neck when needed. This is a particular advantage in playing Irish music on the guitar, as it enables the player to move quickly between keys without sacrificing drone strings; and c) fifth-string capo: The five-string banjo, with its short fifth string, poses a particular problem for using the capo. For many years now Shubb has had available a fifth-string capo, consisting of a narrow metal strip fixed to the side of the neck of the instrument, with a sliding stopper for the string. Other options are to use model railroad spikes to hold the string down at higher frets or simply to retune the string to fit with the pitch of the other strings with the capo applied.

U.S. Pat. No. 4,250,790 to Shubb dated Feb. 17, 1981 discloses an adjustable locking capo wherein the capo is installed from the upper portion of the fretboard. The Shubb capo has the disadvantage of requiring two hands to properly apply or move, and its adjustment is more complicated than some other capos. Additionally, the Shubb capo does not provide engagement from the lower portion of the fretboard, self-centering features, variable pads or personalization features.

U.S. Pat. No. 4,503,747 to Labbe dated Mar. 12, 1985 discloses a capo comprising a rollable member attached via a yoke. A roller capo facilitates quick key changes in the middle of tunes or sets by having rollers both holding down the strings and behind the neck, allowing the capo to roll along the neck when needed. However, this capo does not provide quick implementation, quick disengagement, one-handed operability, engagement from the lower portion of the fretboard, self-centering features, variable pads or personalization features.

U.S. Pat. No. 4,823,670 to Gherman dated Apr. 25, 1989 discloses a capo mounted with flexible straps. U.S. Pat. No. 5,792,969 to Shubb dated Aug. 11, 1998 discloses a capo in which pressure is obtained through a screw driven adjustable stop. These capos provide adjustable tension, but do not provide quick implementation, quick disengagement, one-handed operability, engagement from the lower portion of the fretboard, self-centering features, variable pads or personalization features.

U.S. Pat. No. 6,008,441 to Steinberger dated Dec. 28, 1999 discloses a capo comprising two hingedly connected jaws with a torsion spring, and U.S. Pat. No. 6,271,448 also to Steinberger dated Aug. 7, 2001 discloses a capo comprising a rollable member attached via a yoke capable of sliding. A roller capo facilitates quick key changes in the middle of tunes or sets by having rollers both holding down the strings and behind the neck, allowing the capo to roll along the neck when needed. However, these capos do not provide one-handed operability, engagement from the lower portion of the fretboard, self-centering features, variable pads or personalization features.

Numerous patents disclose quick implementation and operation, such as U.S. Pat. No. 6,459,025 to D'Addario dated Oct. 1, 2002 which discloses a capo housing a ratchet and pinion gear assembly; U.S. Pat. No. 6,528,711 to Paige dated Mar. 4, 2003 which discloses a capo comprising spring biased jaw members; U.S. Pat. No. 6,635,813 to Campling dated Oct. 21, 2003 which discloses a capo adjacent to side of the neck with releasable locking means; U.S. Pat. No. 7,566,824 to Small dated Jul. 28, 2009 which discloses a capo with a second arm connected to a first arm at an angle less the 180 degrees; U.S. Pat. No. 7,745,710 to Campling dated Jun. 29, 2010 which discloses a capo wherein the pivotal connection is behind the fingerboard inboard of a side edge of the fingerboard; U.S. Pat. No. 7,932,450 to Chen dated Apr. 26, 2011 which discloses trigger implemented clamp with an adjustment end; U.S. Pat. No. 7,939,736 to Campling dated May 10, 2011 which discloses a capo in which pressure is obtained through a screw driven adjustable stop; and U.S. Pat. No. 7,973,227 to Paige dated Jul. 5, 2011 which discloses a yoke based capo. However, these capos do not teach self-centering functionality of the neck pad, variable neck pads, changeable inlays, or ability to engage the musical instrument from the lower portion of the neck, which provides quicker engagement, disengagement, and change of position than conventional capos.

While the foregoing examples of capos and other tools are usable for their intended purposes, a need still exists in the art for an improved capo. In particular, there is a need for an improved capo, and method of engaging same, which is capable of being engaged, disengaged and adjusted quickly. Specifically, there is a need for a capo that can be engaged quickly, disengaged quickly, changed quickly, operated with one hand, whose tension can be adjusted, used as a slide, configured for multiple strings, self-centered, with interchangeable neck pads, with interchangeable inlays, and which can be engaged from the lower portion of the neck of a musical instrument.

SUMMARY OF THE INVENTION

In accordance with the present invention, there is provided an apparatus for use with a musical instrument that provides for quick and flexible use, and provides personalization features to enhance the performer's presence. The subject capo has a generally L-shaped frame which is connected to a lever, thus providing a generally U-shaped device. In between the lever and the free end portion of the frame, a pincher with a generally slightly curved shape is connected to both the frame and the lever at the connecting point of the frame to the lever. A spring is positioned at the lever and the pincher such that when pressure is applied to the lever towards the free end portion of the frame, the pincher move back towards the lever, opening space to receive the neck of a musical instrument. When the pressure on the lever is removed, the spring pushes the pincher back towards the free end portion of the frame, thus putting pressure on the back of the neck of the musical instrument and pressing the fretted surface and strings against the free end portion of the frame, thus causing the strings to vibrate at a different frequency.

In accordance with the present invention, there is provided a trigger-style capo which flips the lever around 180 degrees so that it can easily be pinched and put on and moved around the neck of the guitar with a pinching motion of the fret board hand. Specifically, the present invention is engaged from the lower portion, or treble side, of the neck; in other words, as you are holding a stringed instrument in playing position with the neck horizontal, the capo is engaged with the neck by squeezing the capo to open it below the neck and bring it up from below the lower portion of the neck (proximal to the ground on a horizontal plane) to engage with the neck. This enables the player to squeeze the capo with the fretting hand in its natural position on the neck. Additionally, this makes it easier to slide the capo up and down the neck while playing, greatly increasing the player's creative possibilities. The subject capo may also be engaged with the neck from the top portion, or bass side, of the neck, but some of the advantages of quick engagement and disengagement are lost in this configuration.

One embodiment of the present invention comes with multiple neck pads that are easily swapped out by the user. Geometry of pad and frame allows for easy insertion and removal by user, enabling the user to quickly adapt to using different musical instruments with different numbers of strings. Unlike other capos, the present invention can be configured for use with musical instruments having 6-strings, 5-strings, classical configuration, slide configuration, and partial (3 strings). The neck pads can have different radii or curvature, so as to accommodate stringed instruments with different neck configurations. The neck pads can be configured to accommodate different musical styles, such as a 12 string version, a partial covering 3 strings, a drop D with a cutaway for the E string and covering the bottom 5 strings. Additionally, the neck pad can be manufactured from polyoxymethylene or similar material, which allows the neck pad to more easily center itself on the fretted surface of the musical instrument's neck and reduces wear grooves in the neck pad. In one embodiment of the present invention, the neck pad is manufactured from a mixture of polyoxymethylene and 5% polytetrafluoroethylene which provides less noise that just polyexymehylene when used as a slide. Additionally, when the neck pad is made of such a rigid material, the stringed instrument tends to stay in tune because the capo is not binding to the strings, but rather providing slidable pressure, and thus not stretching the strings. Additionally, the neck pad can replaced with a neck pad made of rubber for users who prefer.

The pincher of the capo can be of a curved shape to more readily fit the back of a neck of a musical instrument. The capo can also include one or more pins to secure the frame to the lever and pincher. The capo can also include an axis pin around which the spring flexes, and around which the lever and pincher rotate when pressure is applied to the lever. A spring spacer may also be utilized to accommodate a spring of a specific size.

One embodiment of the present invention comes with changeable inlays in the Capo allow for a variety of options to match guitar finishes, provide branding for the user, and generally allow the user to personalize the capo. In one embodiment of the present invention, the frame has a receptacle to accept a custom inlay. In one embodiment of the present invention, the receptacle comprises a channel formed be ridges running along the perimeter of the frame. Inlays comprising thin strips of material can easily be slid into the channel. Inlays can have variable designs, and can be constructed of various materials, including wood, wood veneers, leather, mother of pearl, of combinations thereof.

BRIEF DESCRIPTION OF THE DRAWINGS

A complete understanding of the present invention may be obtained by reference to the accompanying drawings, when considered in conjunction with the subsequent, detailed description, in which.

A complete understanding of the present invention may be obtained by reference to the accompanying drawings, when considered in conjunction with the subsequent, detailed description, in which.

DETAILED DESCRIPTION

Before the invention is described in further detail, it is to be understood that the invention is not limited to the particular embodiments described, as such may, of course, vary. It is also to be understood that the terminology used herein is for the purpose of describing particular embodiments only, and not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed with the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, if dates of publication are provided, they may be different from the actual publication dates and may need to be confirmed independently.

It should be further understood that the examples and embodiments pertaining to the systems and methods disclosed herein are not meant to limit the possible implementations of the present technology. Further, although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the Claims.

Figure 1:
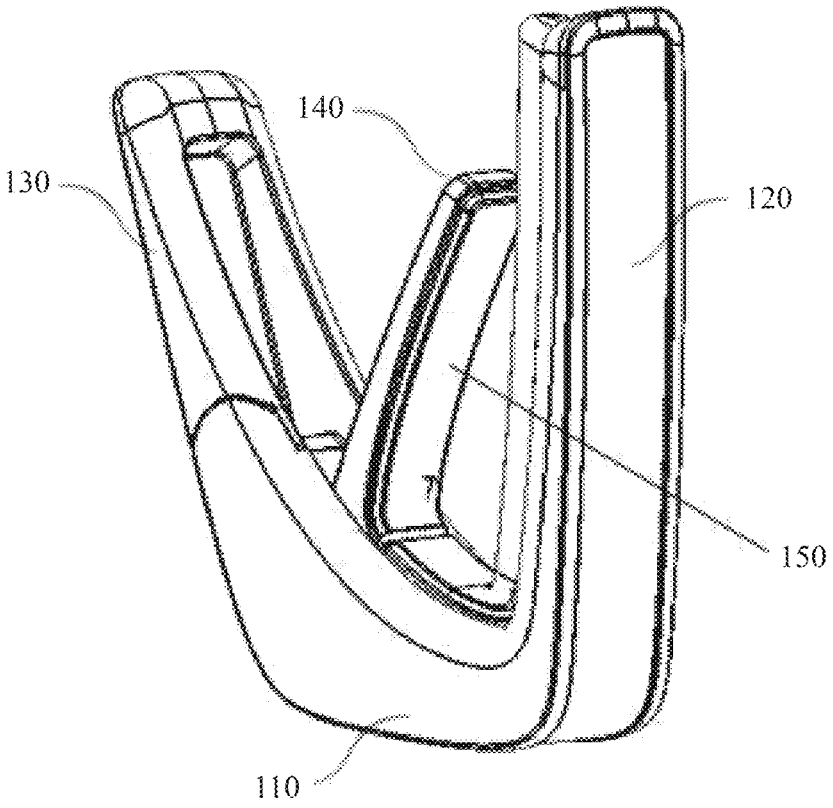
FIG. 1 is a front oblique view diagram of a capo.

Initially referring to FIG. 1, shown is a front oblique view of an embodiment of the present invention providing a trigger-style capo which flips the lever around 180 degrees so that it can easily be pinched and put on and moved around the neck of the guitar with a pinching motion of the fret board hand. The capo comprises a frame 110, an inlay 120, a lever 130, a pincher 140, and a pincher pad 150. The generally L-shaped frame 110 is connected to the lever 130, thus providing a generally U-shaped device. In between the lever 130 and the free end portion of the frame 110, a pincher 140 with a generally slightly curved shape is connected to both the frame 110 and the lever 130 at the connecting point of the frame 110 to the lever 130. When pressure is applied to the lever 130 towards the free end portion of the frame 110, the pincher 140 moves back towards the lever 130, opening space to receive the neck of a musical instrument. When the pressure on the lever 130 is removed, the pincher 140 moves back towards the free end portion of the frame 110, thus putting pressure on the back of the neck of the musical instrument and pressing the fretted surface and strings against the free end portion of the frame 110.

Figure 2:
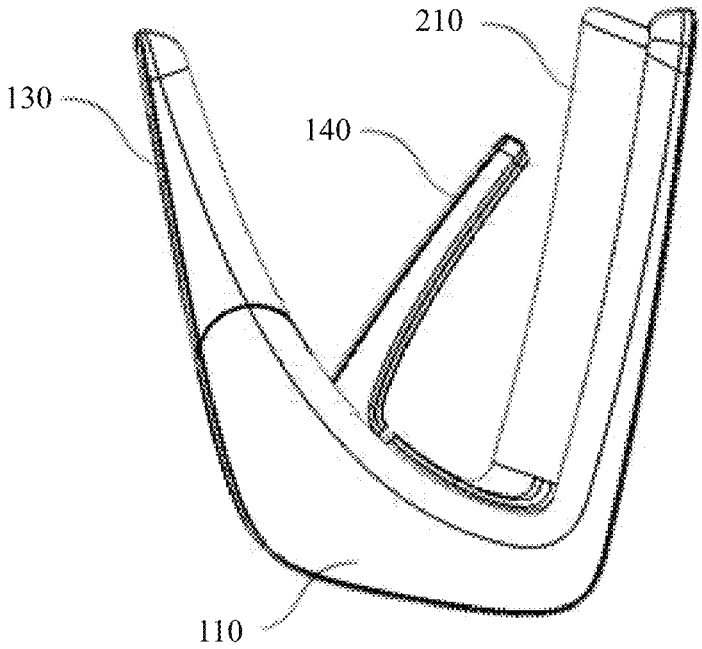
FIG. 2 is a side view diagram of a capo.

Turning now to FIG. 2, shown is a side view of a capo comprising the frame 110, lever 130, pincher 140, as well as a neck pad 210. In one embodiment of the present invention, the neck pad 210 which is used to transversely apply pressure to the strings of the guitar can be replaced with one of a plurality of neck pads of varying lengths, generally between 30-70 mm, to accommodate different type or styles of fretted musical instruments. The frame 110 contains a receptacle which can accept any of the various sizes of neck pads available. Additionally, once a neck pad 210 has been installed, it can easily be replaced with another neck pad of different size, enabling the capo to quickly adapt to another musical instrument.

Figure 3:
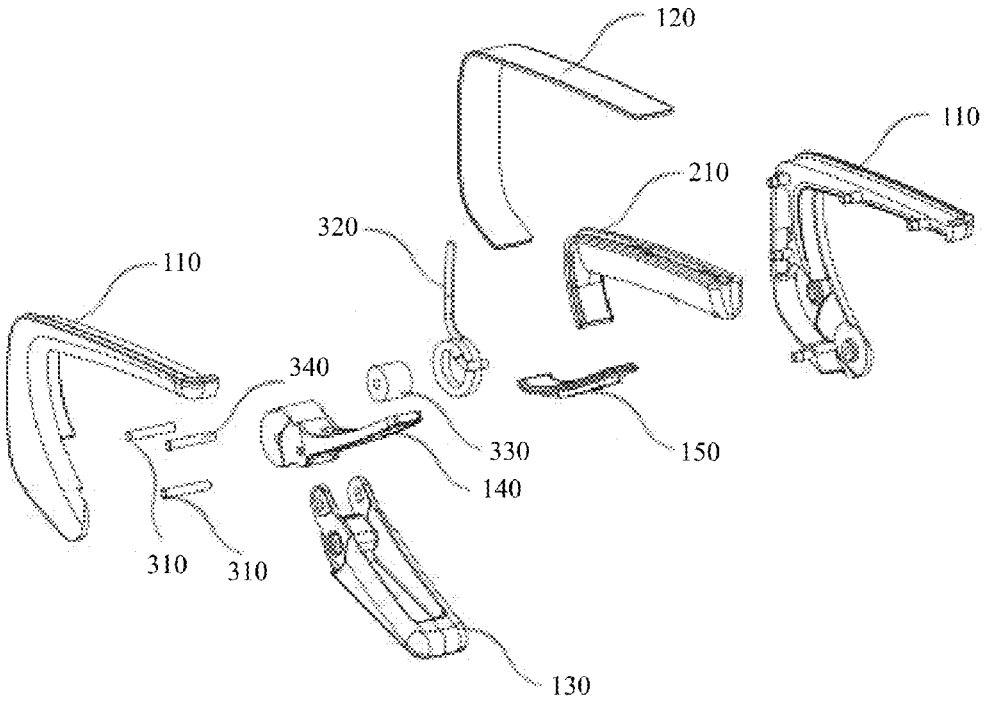
FIG. 3 is a side view exploded diagram of a capo.

Turing now to FIG. 3, shown is a side exploded view of a capo comprising the frame 110, lever 130, pincher 140, as well as a neck pad 210 and pincher pad 140, and also showing two pins 310, spring 320, spring spacer 330, and axis pin 340. The two frame components 110 are covered on the exterior face with an inlay 120. The interior free end portion the frame 110 provides the receptacle for neck pad 210. The frame components 110 are attached by pins 310. The connecting end of the frame components 110 provide means to attach the pincher 140, lever 130 and spring 320. Pincher 140 includes means of attaching pincher pad 150, which provides transverse pressure against the back of the neck of the musical instrument. Pincher 140 is attached to frame components 110 by means of pins 310. Spring 320 provides the torsional pressure to pincher 140, which can be temporarily relieved by application of pressure to lever 130, which rotates around axis pin 340.

Figure 4:
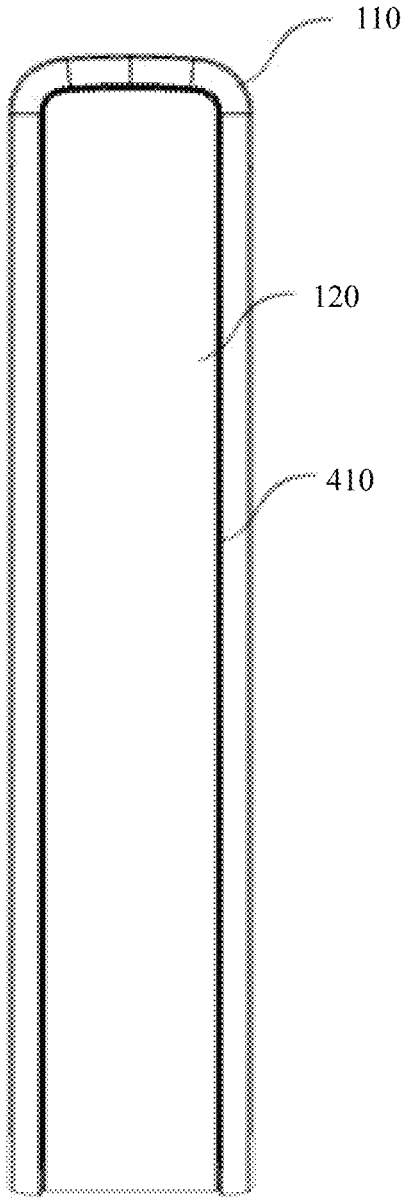
FIG. 4 is a front view diagram of a capo.

Turning now to FIG. 4, shown is a front view diagram of a capo. The inlay 120 covers most of the face of the frame 110, except for a narrow ridge which comprises the top of the inlay channel 410, into which the inlay 120 is positioned. Inlays may be manufactured from many different types of decorative materials, including natural accents such as abalone shell, Zebrawood, Hawaiian Koa, mother of pearl, and birdseye maple. The inlays can further be personalized with engravings, such as names or patterns.

Figure 5:
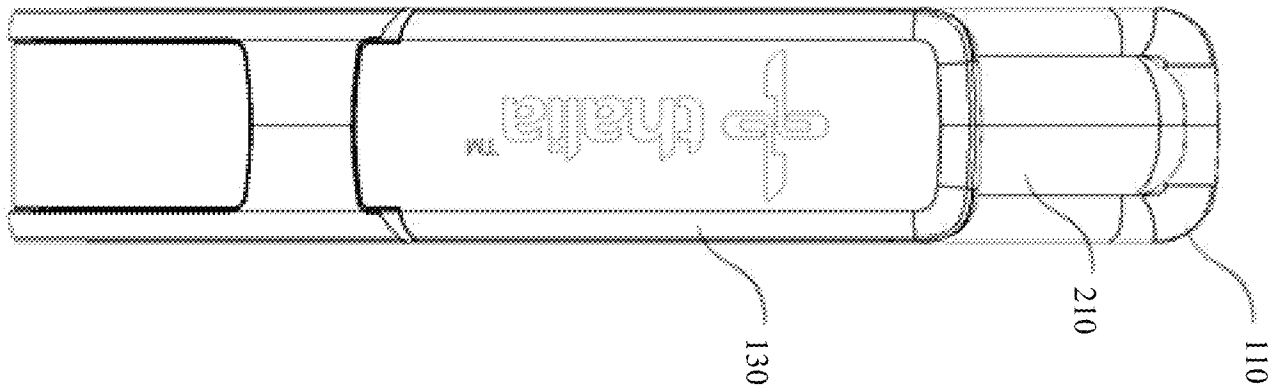
FIG. 5 is a rear view diagram of a capo.

Turning now to FIG. 5, shown is a rear view diagram of a capo showing the end of the free end portion of the frame 110, a portion of the neck pad 210, and the exterior face of the lever 130.

Figure 6:
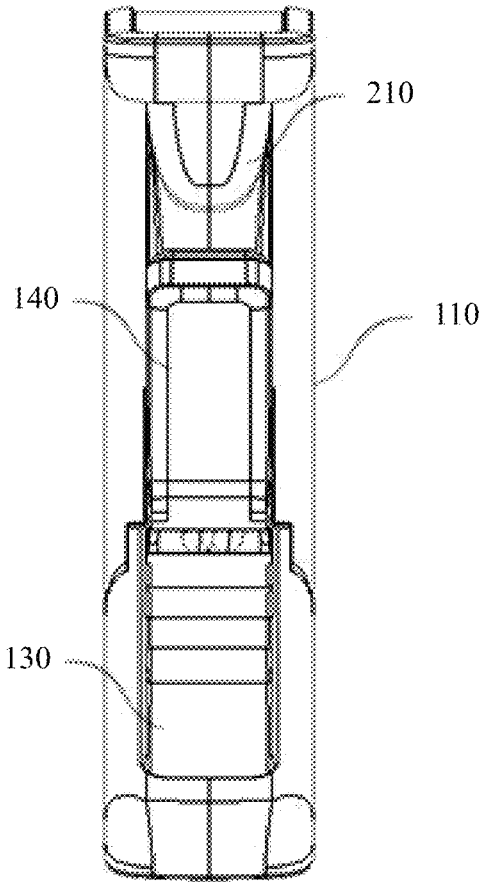
FIG. 6 is a top view diagram of a capo.

Turning now to FIG. 6, shown is a top view diagram of a capo showing an edge of the frame 110, the top of the free end of the lever 130, the pincher 140 and the front of the neck pad 210.

Figure 7:
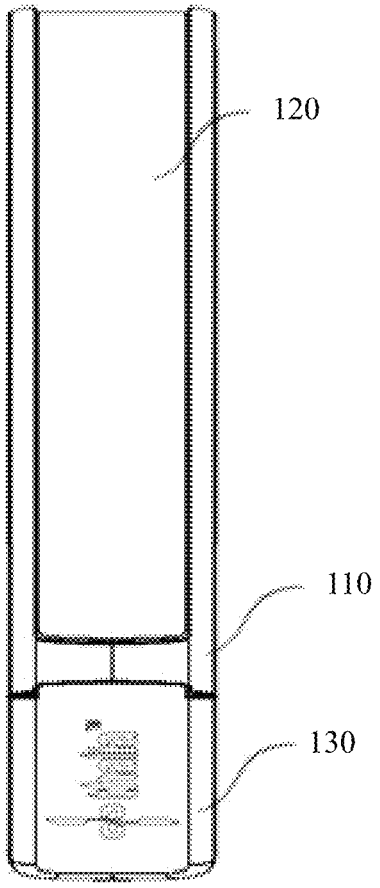
FIG. 7 is a bottom view diagram of a capo.

Turning now to FIG. 7, shown is a bottom view diagram of a capo, including the connecting end of the frame 100, the inlay 120 and the connecting end of the lever 130.

Figure 8:
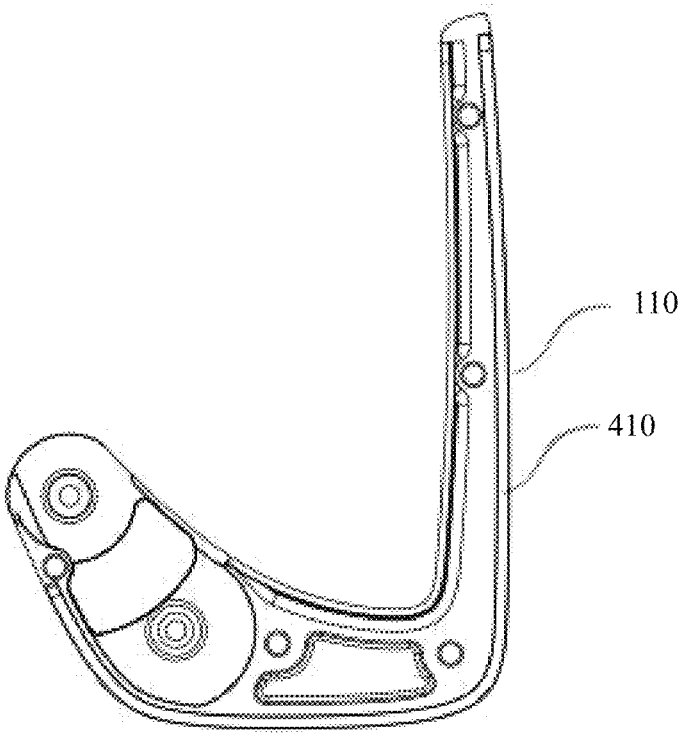
FIG. 8 is a side cross-section view of a capo.

Turning now to FIG. 8, shown is a side cross-section view of the frame 110 in which can be seen the inlay channel 410 running along the exterior face of the frame 110. In an embodiment of the present invention, the frame 110 has a receptacle or inlay channel 410 to accept a custom inlay. In one embodiment of the present invention, the receptacle comprises an inlay channel 410 formed be ridges running along the perimeter of the frame. Inlays comprising thin strips of material can easily be slid into the inlay channel 410.

Figure 9:
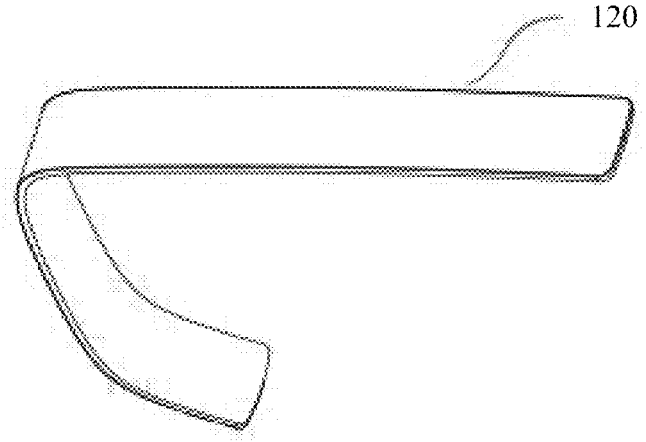
FIG. 9 is an oblique view diagram of an inlay.

Turning now to FIG. 9, shown is an oblique view diagram of an inlay 120. The inlay 120 can be comprised of any number of materials and designs that can be installed on the capo. Inlays 120 comprising thin strips of material can easily be slid into the channel. Inlays 120 can have variable designs, and can be constructed of various materials, including wood, wood veneers, leather, mother of pearl, of combinations thereof.

Figure 10:
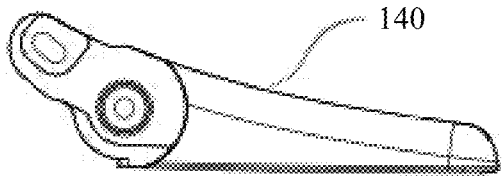
FIG. 10 is an oblique view diagram of a lever.
Figure 11:
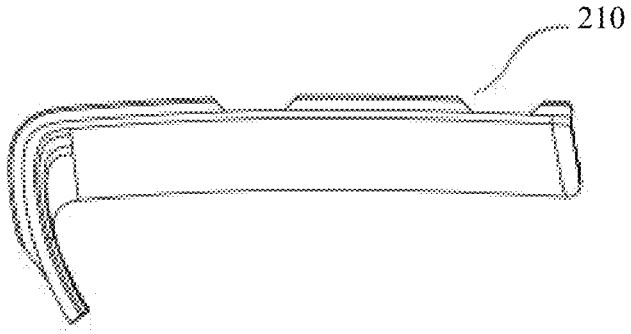
FIG. 11 is an oblique view diagram of a neck pad.
Figure 12:
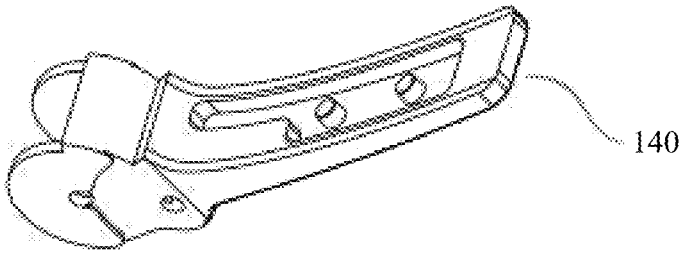
FIG. 12 is an oblique view diagram of a pincher.
Figure 13:
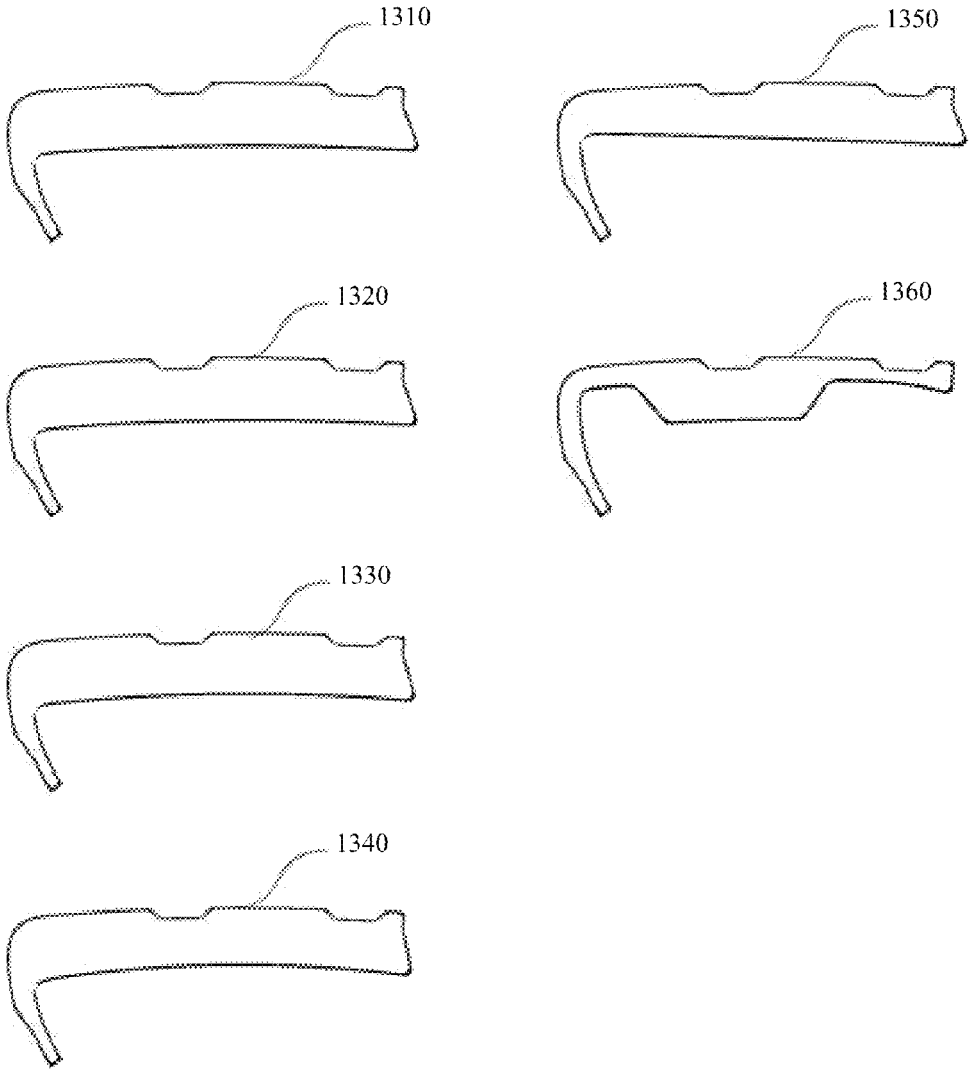
FIG. 13 is a side view diagram of a tuning kit.

Finally, FIG. 10 shows an oblique view diagram of lever 140, FIG. 11 shows an oblique view diagram of a neck pad, and FIG. 12 shows an oblique view diagram of a pincher. In one embodiment of the present invention, the capo is provided with a tuning kit comprising a plurality of neck pads with different characteristics to accommodate different neck or musical styles. Shown in FIG. 13 is a tuning kit comprising six interchangeable neck pads. One neck pad 1310 has a 16.5" radius for use with a twelve string guitar; another neck pad 1320 has a 13.5" radius for use with a standard neck; neck pad 1330 has a 11.5" radius; neck pad 1340 has a 7.5" radius; neck pad 1350 has no radius; and neck pad 1360 has a partial radius.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A capo comprising:

a. a frame having a free end portion and a connecting end;

b. a lever having a free end portion and a connecting end configured to accept a spring, wherein said connecting of said lever is connected to said connecting end of said frame;

c. a pincher moveable relative to said frame and said lever, said pincher having a free end portion and a connecting end configured to accept a spring, wherein said connecting end of said pincher is connected to said connecting end of said frame and said connecting end of said lever, and wherein said spring is connected to said pincher and said lever from an axis of said connecting end of said pincher, whereby pressure applied to said lever causes said pincher to move towards said lever.

2. The capo of claim 1, further comprising a plurality of pins, wherein said pins secure said frame to said connecting end of said pincher and said connecting end of said lever.

3. The capo of claim 1, further comprising an axis pin, around which said connecting end of said pincher and said connecting end of said lever rotate.

4. The capo of claim 1, further comprising a spring spacer, wherein said connecting end of said pincher is further configured to accept said spring spacer and said spring spacer provides said axis for said spring.

5. The capo of claim 1, further comprising a neck pad, wherein the interior portion of said frame is configured to accept said neck pad.

6. The capo of claim 5, further comprising a plurality of neck pads of different sizes, wherein said interior portion of said frame is configured to accept any one of said plurality of neck pads.

7. The capo of claim 5, wherein said neck pad is constructed of polyoxymethylene or similar material.

8. The capo of claim 5, wherein said neck pad is constructed of polyoxymethylene and about 5% polytetrafluoroethylene.

9. The capo of claim 1, further comprising a pincher pad, wherein said pincher is configured to accept said pincher pad.

10. The capo of claim 1, further comprising an inlay, wherein said frame is configured to accept said inlay.

11. The capo of claim 10 wherein said frame is configured to accept said inlay by means of an inlay channel comprising a lipped ridge running along the front perimeter of said frame from the distal edge of said connecting end of said frame along said free end portion of said frame to the proximal edge of said connecting end of said frame.

12. The capo of claim 10, further comprising a plurality of inlays of different designs, wherein said frame is configured to accept any one of said plurality of inlays.

13. The capo of claim 10, further comprising a plurality of inlays of different materials, wherein said frame is configured to accept any one of said plurality of inlays.

14. A capo for use with a stringed, musical instrument having a neck, a fretted surface on one side of the neck, and strings extending longitudinally over said fretted surface, said capo comprising:

a. a generally L-shaped frame having a connecting end and a free end portion, wherein said free end portion applies pressure to said strings;

b. a lever having a free end portion and a connecting end configured to accept a spring, wherein said connecting end of said lever is connected to said connecting end of said frame;

c. a pincher moveable relative to said frame and said lever, said pincher having a free end portion and a connecting end configured to accept a spring, wherein said connecting end of said pincher is connected to said connecting end of said frame and said connecting end of said lever, and wherein said spring is connected to said pincher and said lever at an axis of said connecting end of said pincher, whereby pressure applied to said lever causes said pincher to move towards said lever providing space to receive from the bottom portion said neck of said musical instrument between said pincher and said free end portion of said frame.

15. The capo of claim 14, further comprising a plurality of pins, wherein said pins secure said connecting end of said frame to said connecting end of said pincher and said connecting end of said lever.

16. The capo of claim 14, further comprising an axis pin to provide said axis, around which said connecting end of said pincher and said connecting end of said lever rotate.

17. The capo of claim 16, further comprising a spring spacer, wherein said connecting end of said pincher is further configured to accept said spring spacer and said spring spacer is secured by said axis pin.

18. The capo of claim 14, further comprising a neck pad for barring said strings, wherein the interior portion of said frame is configured to accept said neck pad.

19. The capo of claim 18, further comprising a plurality of neck pads of different sizes to accommodate musical instruments with varying number of strings, wherein said interior portion of said frame is configured to accept any one of said plurality of neck pads.

20. The capo of claim 18, wherein said neck pad is constructed of polyoxymethylene or similar material which enables said capo to more easily center itself relative to said fretted surface.

21. The capo of claim 14, further comprising a pincher pad, wherein said pincher is configured to accept said pincher pad.

22. The capo of claim 14, further comprising an inlay, wherein said frame is configured to accept said inlay.

23. The capo of claim 22 wherein said frame is configured to accept said inlay by means of a channel comprising a lipped ridge running along the front perimeter of said frame from the distal edge of said connecting end of said frame along said free end portion of said frame to the proximal edge of said connecting end of said frame.

24. The capo of claim 22, further comprising a plurality of inlays of different designs, wherein said frame is configured to accept any one of said plurality of inlays.

25. The capo of claim 22, further comprising a plurality of inlays of different materials, wherein said frame is configured to accept any one of said plurality of inlays.

* * * * *